United States Patent [19]

Ball et al.

[11] Patent Number: 4,616,558

[45] Date of Patent: Oct. 14, 1986

[54] GASEOUS FLUID DISTRIBUTION DEVICES

[75] Inventors: Lewis C. Ball, Clinton; Anthony F. Delia, Camillus, both of N.Y.

[73] Assignee: Total Air, Inc., Mattydale, N.Y.

[21] Appl. No.: 667,144

[22] Filed: Nov. 1, 1984

[51] Int. Cl.[4] ..... F24F 13/075

[52] U.S. Cl. ..... 98/40.11; 98/40.1

[58] Field of Search ..... 98/40.05, 40.10, 40.11, 98/40.12, 40.20, 40.24

[56] References Cited

U.S. PATENT DOCUMENTS

| | | | |
|---|---|---|---|
| 1,725,353 | 8/1929 | Hinrich | 98/40.24 |
| 2,630,054 | 3/1953 | Peterson | 98/40.2 |
| 3,012,493 | 12/1961 | Ekeren | 98/40.11 |
| 3,033,097 | 5/1962 | Phillips . | |
| 3,065,684 | 11/1962 | O'Day | 98/40.11 |
| 3,166,001 | 1/1965 | Person et al. | 98/40.11 |
| 3,308,741 | 3/1967 | Chambers | 98/40.11 |
| 3,327,606 | 6/1967 | Little et al. | 98/40.11 |
| 3,358,577 | 12/1967 | Thomson | 98/40.11 X |
| 3,363,532 | 1/1968 | Horneff | 98/40.1 X |
| 3,548,735 | 12/1970 | Sweeney | 98/40.11 |
| 3,631,788 | 1/1972 | Larkfeldt | 98/40.11 |
| 3,730,072 | 5/1973 | Soderlund et al. | 98/40.11 |

FOREIGN PATENT DOCUMENTS

| | | | |
|---|---|---|---|
| 2120778 | 12/1983 | United Kingdom | 98/40.1 |
| 313032 | 8/1971 | U.S.S.R. | 98/41.3 |

*Primary Examiner*—Harold Joyce

*Attorney, Agent, or Firm*—Hughes & Cassidy

[57] ABSTRACT

Devices for effecting a patterned, non-turbulent, non-aspirating flow of air or other gaseous fluid into a room or other confined area or enclosure of finite vertical and horizontal dimensions. These devices have a perforate outlet member and vanes for directing the gas in a controlled manner through the perforations in the outlet member. The vanes, the configuration of the outlet member, and the size and total volume of the perforations are selected to match the pattern in which the gaseous fluid is delivered to the user's requirements. Adjustable vanes may be provided so that the pattern of the air delivered by the device can be changed without altering the size or location of the vanes, the size or configuration of the outlet member, or the size or total volume of the perforations.

16 Claims, 4 Drawing Figures

GASEOUS FLUID DISTRIBUTION DEVICES

The present invention relates to devices which can be employed to effect a flow of air or other gaseous fluid from the ceiling of a room or other confined area or enclosure having determinate vertical and horizontal dimensions into that area in a specified pattern. Furthermore, the gaseous fluid is introduced into the confined area with minimum turbulence and, also, without aspiration; i.e., the gaseous fluid is introduced in such a manner that gaseous fluids and suspended particulates in the confined area are not drawn back up into the distribution device and mixed with the gaseous fluid introduced into the confined area.

Typically, the gaseous fluid will be introduced into the confined area serviced by a distribution device in a pattern which will result in a uniform distribution over that dimension of the enclosure spanned by the distribution device. This is not essential, however; non-uniform flow patterns can equally well be supplied if dictated by the user's requirements.

Among the advantages of our novel gaseous fluid (typically air) distribution devices, in addition to those just specified, are that: they are efficient because the pressure drop across the unit is low, they are easily attached to T-grid and similar ceiling suspension systems, and they can be combined, without modification, with terminal high efficiency, e.g., HEPA, filters (see U.S. Pat. No. 4,175,936 issued Nov. 27, 1979, to Lough et al for DIFFUSER WITH REPLACEABLE FILTER) in applications in which an ultraclean air supply, for example, is required.

Applications of the present invention are legion. Among those of immediate importance are the supply of air to rooms where dust suppression is important. Such rooms include those in which pharmaceutical grinding, milling, and tableting operations are carried out and rooms in which laboratory animals are housed for experimental purposes. Electronic laboratories and assembly rooms and other hi-tech manufacturing facilities are examples of other applications in which the principles of our invention can be employed to advantage. In the foregoing and other environments, HEPA and other high efficiency filters are utilized to insure an ultraclean air supply. Our invention can be employed in such cases to eliminate the narrow, ceiling-to-floor, columnar flow of air that would otherwise exist. Other applications of our invention will readily occur to those skilled in the arts to which this invention relates.

The advantages of the invention identified above are accomplished in an efficient, straightforward manner with mechanically simple devices which can be manufactured at relatively low cost.

Generally, these devices are coupled to a component or subassembly with structure which defines an inlet plenum for the gases being furnished by the device and a supply duct communicating with the inlet plenum which may house a HEPA or other high efficiency filter. Our novel device, associated with that subassembly, includes a perforate outlet member of generally semielliptical cross sectional configuration. The device effects a patterned flow of the gaseous fluid into the room or other confined area serviced by it. That goal is furthered by flow directing vanes which proportion the flow of fluid from the inlet plenum among the several laterally related segments of an outlet plenum bounded by the perforate member and defined by the vanes.

Preferably, the latter are made adjustable so that the pattern of fluid flow effected by the device can be varied without structural alteration of it.

Finally, the flow distribution device will also include an appropriate arrangement for suspending it from, or in a specified relationship to, the ceiling of the enclosure it services. T-bar lay-in systems are only one type of suspension arrangement that can be employed for our purposes.

As will be apparent from the foregoing, the devices of the present invention can, at least at the present time, probably be most gainfully employed to supply air of one quality or another to a room designed for any one of a variety of purposes. Other devices designed for this same general purpose have of course been heretofore proposed. Those known to and believed by us to most resemble the devices we have invented are disclosed in U.S. Pat. Nos.: 2,504,472 issued Apr. 18, 1960, to Van Alsburg for AIR DISTRIBUTOR; 2,576,905 issued Nov. 27, 1961, to Labus for ADJUSTABLE AIR DISTRIBUTOR; 2,848,935 issued Aug. 26, 1968, to Demuth for AIR DISTRIBUTING DEVICES; 3,033,097 issued May 8, 1962, to Phillips for AIR DISTRIBUTION CONTROL OUTLET; 3,854,386 issued Dec. 17, 1974, to Heddrick for AIR DIFFUSION; 4,175,936 issued Nov. 17, 1979, to Lough et al for DIFFUSOR WITH REPLACEABLE FILTER; 4,188,862 issued Feb. 19, 1980, to Douglas III for REGISTER ASSEMBLY; 4,253,284 issued Mar. 3, 1981, to Schmidt et al for VENTILATING AND AIR CONDITIONING ARRANGEMENT; and 4,276,818 issued July 7, 1981, to Makara et al for AIR DISTRIBUTOR.

Only a brief perusal of the foregoing patents will make it obvious to those skilled in the arts dealing with our invention that the devices with which we are concerned are considerably different from any disclosed in the above-listed patents. There is no suggestion that any of the patented devices have the capability of introducing a gaseous fluid into a serviced enclosure from the ceiling thereof in a specified, typically uniform, pattern; that the fluid can be introduced into the enclosure with minimal turbulence; or that the fluid can be introduced without drawing air or other gaseous fluid or suspended particulate material in the room back into the fluid supplied by the distribution device. Furthermore, the foregoing flow distribution devices are, with one or two possible exceptions, considerably more complicated than those novel devices we have invented.

From the foregoing, it will be apparent to those to whom this specification is addressed that the primary object of our invention resides in the provision of novel, improved devices for effecting the flow of air or other gaseous fluid into a room or other enclosure from the ceiling or other upper boundary (or wall) of that enclosure.

Other important, but more specific, objects of our invention reside in the provision of devices as defined in the preceding object which:

- are capable of effecting the flow of a gaseous fluid into the enclosure in a specified pattern;
- can be readily programmed to vary the flow pattern without structurally altering the device;
- which are capable of effecting the flow of gaseous fluid into the enclosure with minimal turbulence;
- which are capable of so effecting the flow of fluid into the room or other confined area or enclosure that air or other fluid or suspended particulate material in that room or enclosure is not drawn back into and mixed with that being supplied by the device;

which can be employed, without modification, with high efficiency filters such as those of the HEPA type in applications where air with exacting requirements is specified;

which are characterized by low pressure drops and corresponding energy savings;

and which are capable of accomplishing the just-enumerated objects efficiently by way of devices which are structurally and mechanically uncomplicated and can be supplied at a relatively low cost.

Still other objects and advantages and other important, novel features of our invention will be apparent to the reader from the foregoing, from the appended claims, and from the ensuing detailed description and discussion taken in conjunction with the drawing in which:

FIG. 1 is a generally pictorial view of a device or unit which includes a gaseous fluid flow effecting or distribution assembly constructed in accord with and embodying the principles of the present invention; this view also pictorially shows: a sub-assembly (which may include a HEPA or other high efficiency filter) for supplying the gaseous fluid to the flow effecting assembly and the relationship between the assembly of the present invention and the ceiling or upper wall of the enclosure serviced by it;

Figure 1:
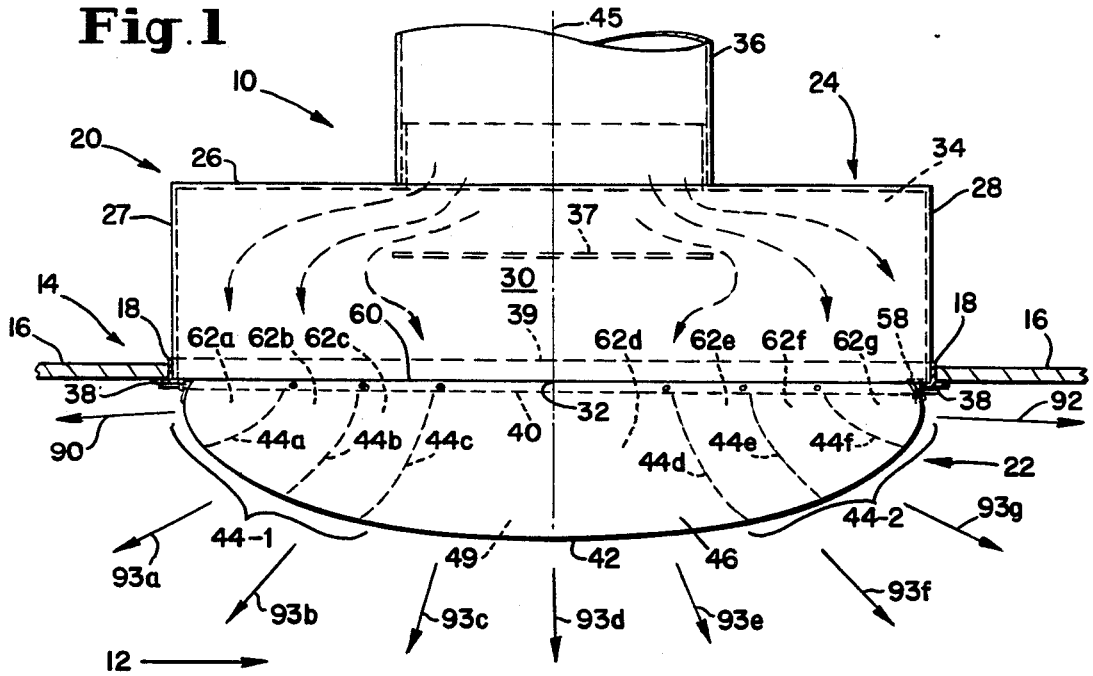

Referring now to the drawing, FIG. 1 depicts, pictorially, a unit 10 for effecting a patterned flow of gaseous fluid (hereinafter referred to as "air" or "clean air" for the sake of convenience) into a room or enclosure 12 which has determinate dimensions and an upper wall or ceiling 14. Unit 10 is designed to effect a single pass of the fluid it supplies through enclosure 12. To further this objective outlet registers (not shown) through which the supplied fluid can be exhausted will typically be provided at the lower edges of the enclosure.

In that embodiment of our invention illustrated in FIG. 1, ceiling 14 is of the conventional suspended type in which tiles 16 are supported by T-bars 18, the latter being in turn supported by joists or other load-bearing structural members (not shown).

Unit 10 may, in this exemplary application of our invention, be supported from, and located between, adjacent T-bars 18 of the ceiling's grid structure.

Referring still to FIG. 1, unit 10 includes an upper, gaseous fluid inlet sub-assembly 20 and a lower, outlet and flow directing assembly 22 constructed in accord with the principles of the present invention.

The typical inlet sub-assembly 20 (which could contain a HEPA type filter) includes a rectangularly configured, boxlike structure 24 which has a horizontal top wall 26 and, depending therefrom, two side walls 27 and 28 and two end walls (only one of which, 30, is shown). The bottom 32 of this structure is perforated and the structure defines an inlet plenum 34 for the gaseous fluids supplied to enclosure 12. These fluids are delivered to the inlet plenum 34 through a supply duct 36 which communicates with the interior of the plenum through the top wall 26 of the plenum defining structure.

As discussed above, unit 10 is capable of effecting a flow of a gaseous fluid supplied by it into enclosure 12 without back flow of air or other gaseous fluids or suspended particulates into the enclosure without aspiration of existent fluids and suspended particles into the fluid flowing into the enclosure from unit 10 and in a pattern meeting the user's requirements. To further these objectives, a preferably adjustable perforate baffle 37 is installed in plenum 34. Typically, baffle 37 will be a disk of approximately the same dimensions as gaseous fluid supply duct 36; and it will be spaced below, and parallel to, the upper wall 26 of the plenum defining structure 24.

In the exemplary application of our invention under discussion, unit 10 is supported from the T-bars 18 of ceiling system 14 as was mentioned above. More particularly, the lower edges of the side walls 27 and 28 of the inlet plenum defining structure 24 rest on the lower flanges of horizontal, suspended ceiling system T-bars 18; there are also spaced apart, parallel T-bars located at right angles to those just mentioned. The end walls of the inlet plenum defining structure are similarly supported from the horizontal flanges of those T-bars. One such T-bar is identified in FIG. 1 by reference character 39, and its lower flange is identified by reference character 40.

Figure 2:
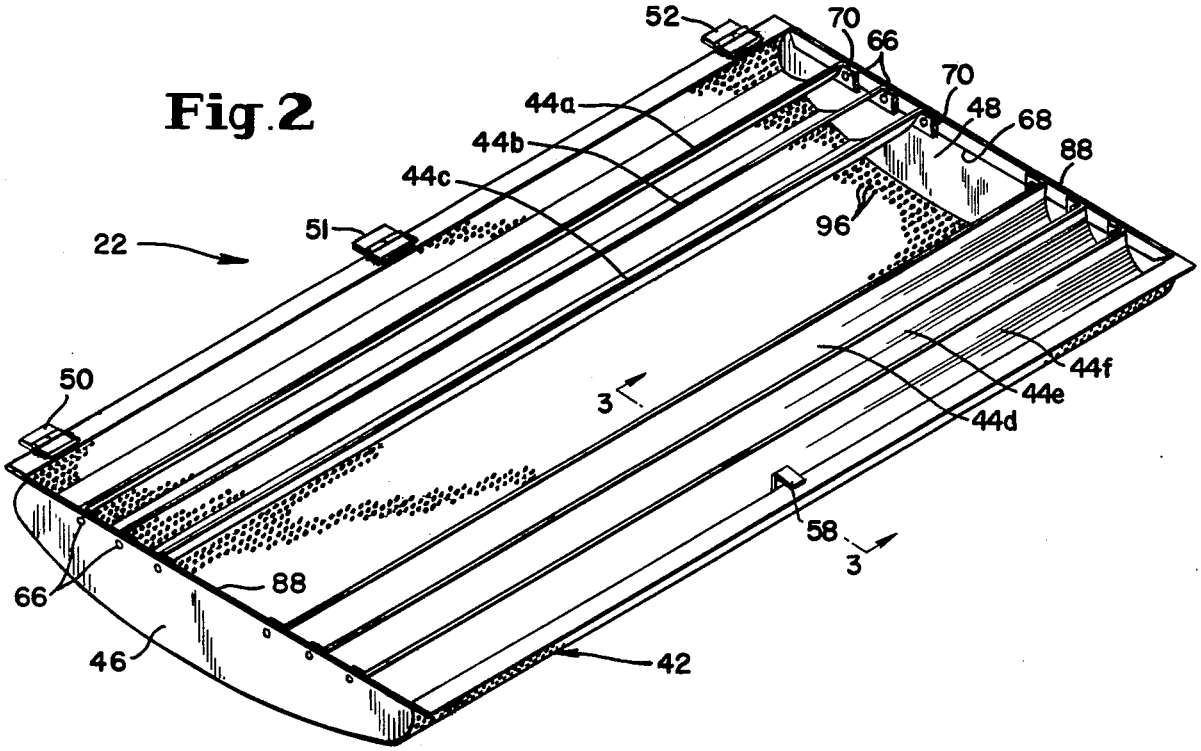
FIG. 2 is a generally perspective view of the flow effecting assembly shown in FIG. 1 and utilized to effect a patterned flow of gaseous flow into the enclosure.
Figure 3:
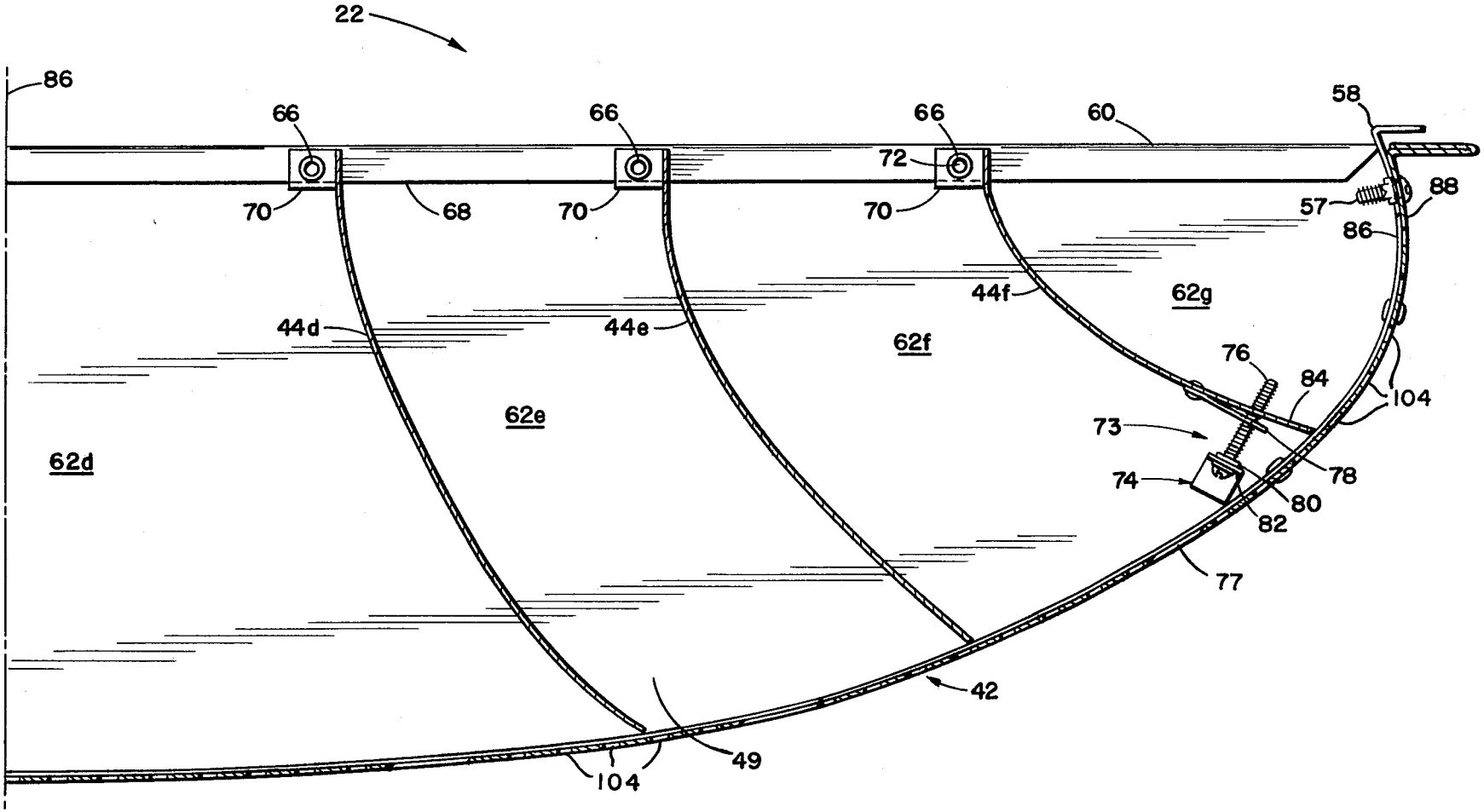
FIG. 3 is a section through the flow effecting assembly of FIG. 2, taken substantially along line 3—3 of the latter figure.

Referring now to FIGS. 2 and 3, in addition to FIG. 1, the patterned flow fluid distributing assembly 22 constructed in accord with the principles of the present invention and incorporated in unit 10 includes a perforate outlet member 42 which has a generally semielliptical configuration; arcuately sectioned vanes 44*a* . . . 44*f* disposed in two arrays 44-1 and 44-2 in mirror image relationships on opposite sides of the vertical centerplane 45 of unit 10; and plates 46 and 48 at the opposite ends of perforate outlet member 42 which cooperate with the latter to define an outlet plenum 49 for the gaseous fluid supplied to enclosure 12.

In the exemplary embodiment of the invention shown in the drawing, outlet assembly 22 is coupled to the associated, upper, T-bar assembly 18 by hinges 50, 51 and 52 and a latch 58 shown in FIG. 3 and described below.

In the embodiments of the invention illustrated in the drawing, vanes 44*a* . . . 44*f* extend from end-to-end of the elongated, perforate, outlet member 42 and, vertically, from a horizontal location 60 coincident with the upper edges of that member downwardly into juxtaposition with the member.

These vanes can be fixed to the end walls 46 and 48 of outlet member 42 in any desired fashion to proportion the fluid flowing into outlet plenum 49 from inlet plenum 34 between those several lateral segments of the outlet plenum identified by reference characters 62*a* . . . 62*g* in FIG. 1. For example, rivets, spot welds, etc., can be employed for this purpose. This manner of mounting the vanes is the simplest and least expensive; and it is accordingly employed where flexibility in the fluid distribution pattern is not required.

In circumstances where that feature is of import, in contrast, adjustable vanes are employed so that the flow pattern of fluid from outlet plenum 49 can be selectively so varied among those several segments 62*a* . . . 62*g* of that plenum through outlet members 42 into enclosure 12 as to meet the user's requirements.

Referring now specifically to FIG. 3, vanes 44*a* . . . 44*f* can, in their adjustable mode, be supported from the end walls 46 and 48 of the fluid outlet assembly 22 by pivot members 66 which can be rivets, screws, etc. For structural purposes, a depending, integral flange such as that identified by reference character 68 in FIG. 3 will be formed at the upper edge of each end wall 46 and 48; a bracket 70 (only one shown) will be spot welded or otherwise fixed to each end of each vane at the upper edge thereof; and a pivot member 66 will be extended through the bracket, flange, and end wall member proper at both ends of each vane.

Rotation of each vane 44*a* . . . 44*f* about the horizontal, longitudinally extending axis 72 afforded by the pivot member 66 supporting that vane from lower assembly end walls 46 and 48 is provided by adjusting assemblies 73 at the two ends of each vane. For the sake of simplicity, only one of these has been shown.

Referring still to FIG. 3, exemplary adjusting mechanism 73 includes a bracket 74; a threaded adjusting member 76, which can be reached by an adjusting tool such as an Allen wrench, for example, through an opening 81 in perforate outlet member 42; a tinnerman clip 78; and an internally threaded retainer 80. The latter allows threaded adjusting member 76 to rotate relative to the flange 82 of the bracket 74 through which it extends but otherwise keeps that member from moving relative to the flange.

Retainer 78 is riveted or otherwise fixed to the associated vane (44*f* in FIG. 3). The resilience inherent in the retainer and the lower edge portion 84 of the vane and the tendency for these ends of the vane and retainer to move relative to each other as the adjusting member 76 is rotated effect a friction lock. This insures that the adjusting member will remain in the position to which it is rotated in order to pivot the associated vane to the position necessary to effect that flow of gaseous fluid through outlet member 42 consistent with the user's requirements.

Referring now to the several FIGS. 1–3 of the drawing, patterned flow effecting outlet member 42 can be attached to the end members 46 and 48 of the illustrated flow device assembly 22 by riveting or otherwise fastening the perforate outlet member to flanges extending longitudinally from those end members. One of those flanges (shown in FIG. 3) is identifed by reference character 86.

The outlet member 42 extends from end-to-end of flow device assembly 22 and has a generally semielliptical cross-sectional configuration. As best shown in FIGS. 1 and 3, the upper edge portions 88 of the outlet member curve from the vertical back toward the longitudinal centerplane 45 of flow device assembly 22.

This insures that selected portions of the gaseous fluid exiting from outlet plenum 49 into enclosure 12 will flow parallel to the ceiling 14 of the enclosure as shown by flow lines 90 and 92 in FIG. 1.

In most instances, a uniform distribution of the gaseous fluid will be wanted in enclosure 12. The just-described flow of the fluid parallel to ceiling 14 is a requisite to uniform, and other patterned, distributions of the gaseous fluid in the enclosure.

The remainder of the air is directed into enclosure 12 through outlet member 42 from outlet plenum segments 62*a–g* in paths 93*a–g* which, like those identified by arrows 90 and 92, extend from end-to-end of unit assembly 22. The paths taken by these air streams vary from 0 to <90 degrees relative to the longitudinally extending vertical centerplane 45 of unit 10.

A unit such as that shown in FIG. 1 will, in a typical application of our invention, be 24 inches wide and 48 inches long, making it compatible with a conventional suspended ceiling system. This is not requisite, however; and the unit may instead be dimensioned as required by a particular application of the invention. In this respect, the unit may on occasion be advantageously made coextensive in length with the enclosure it services. This eliminates those minor variations in the wanted, patterned distribution of air which might otherwise exist because of the lack of symmetry at the ends of the unit.

Figure 4:
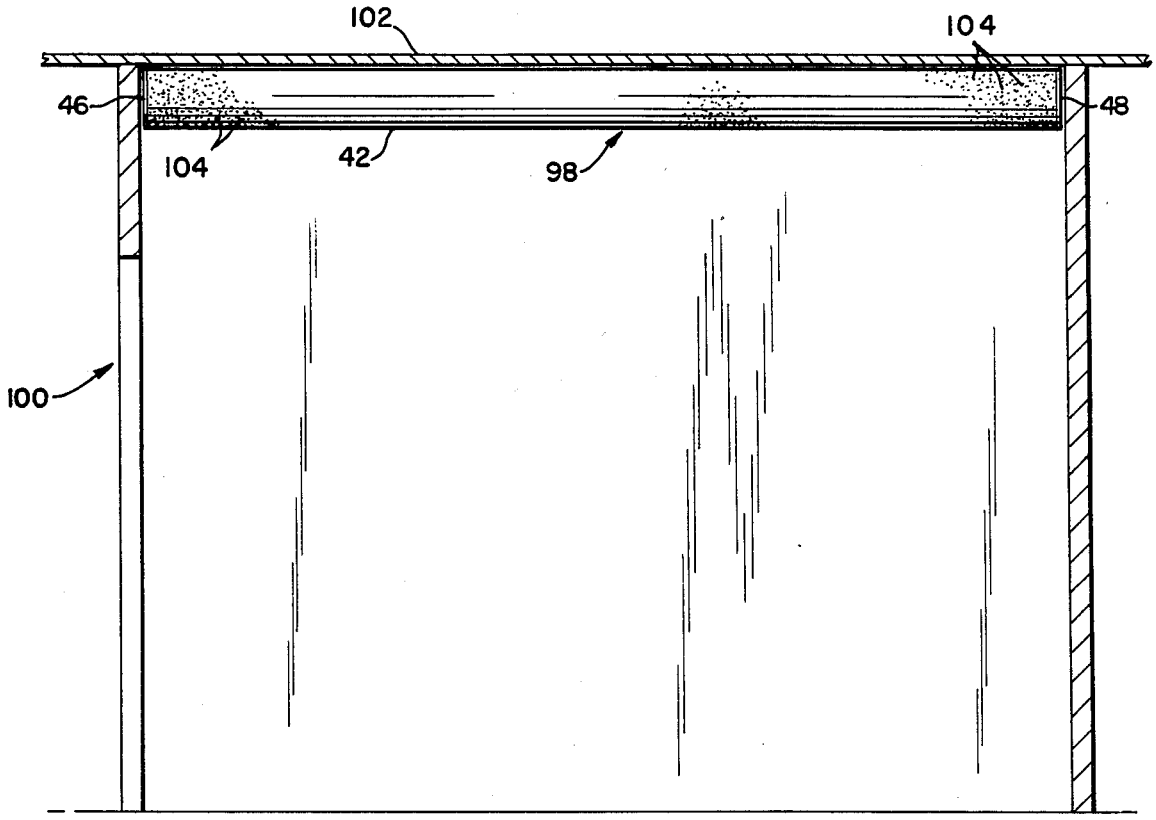
FIG. 4 is a pictorial view of an installation which has a gaseous fluid flow effecting or distributing assembly in accord with the principles of our invention, that assembly extending the length of the enclosure in which it is installed.

An installation of this character is illustrated in FIG. 4. The gaseous fluid distributing unit is identified by reference character 98 and the enclosure in which it is installed by reference character 100. The latter has a ceiling 102 adjacent which unit 98 is mounted.

Typically, a unit as shown in FIGS. 1–3 (or in FIG. 4), and with the dimensions identified above, will be capable of supplying a gaseous fluid with minimal turbulence to and no aspiration to enclosure 12 at an extraordinarily high rate. To ensure against turbulence, perforate outlet member 42 will, in such units, again typically, have a uniformly patterned set of perforations 104, ranging in size from 1/16 to 3/16 inch; and the cumulative area of perforations relative to the total area of the outlet member 42 will range from 8 to 40 percent.

Perforations 104 will typically be circular. This configuration is not essential, however; and rectangular or other shaped slots or perforations can instead be employed, depending upon the exigencies of the particular application to which our invention is put.

As indicated above, the semielliptical configuration of the outlet member is also important as is the inward curvature of that member at its upper edges toward the longitudinal centerplane 45 of the unit. In the exemplary 24-inch-wide units under consideration, those edges have an initial curvature of two inches transitioning through a four-inch curve into the more elliptical, shallower curve spanning the major portion of the unit.

Assembly 22 can be fabricated from a wide variety of sheet materials. One is aluminum which may be anodized. Other suitable materials include stainless and galvanized steels and various plastics.

The physical embodiments of our invention have on occasion been referred to as gaseous fluid distribution devices. This terminology has been employed simply for the sake of convenience and is not intended to in any way be a limitation on the scope of patent protection to which we are entitled as defined by the appended claims.

Furthermore, the invention may be embodied in specific forms other than those disclosed above without departing from the spirit or essential characteristics thereof. The embodiments of the invention disclosed above are therefore to be considered in all respect as illustrative and not restrictive. The scope of the invention is instead indicated by the appended claims, and all changes which come within the meaning and range of equivalency of the claims are intended to be embraced therein.

What is desired to be secured by Letters Patent of the United States is:

1. A device for effecting a non-aspirated flow of air or other gaseous fluid into a room or other enclosure having a ceiling and determined vertical and horizontal dimensions with minimal turbulence, said device comprising: a perforate outlet member having a generally elliptical cross-sectional configuration with side wall portions which are inclined inwardly from the vertical toward the longitudinal centerplane of the device, the perforate outlet member including perforations so located in the inwardly inclined portions thereof that a selected portion of the gaseous fluid flowing into said enclosure through said outlet member flows therethrough in paths which are generally parallel to said ceiling, the remainder of said perforations being so located in said outlet member as to direct that gaseous fluid flowing therethrough into said enclosure in paths inclined at selected angles relative to said first-mentioned paths; end walls at opposite ends of said perforate outlet member; and a plurality of downwardly extending vanes housed in said outlet member and extending the length of and to the lower side of said outlet member for proportioning the flow of the fluid flowing through said outlet member among those end-to-end spanning segments of the perforate outlet member delineated by the lower edges of said vanes to thereby effect a particularly patterned flow of fluid into said enclosure.

2. A device as defined in claim 1 for introducing air or other gaseous fluid into a room or other enclosure as aforesaid wherein said outlet member extends from wall-to-wall of said enclosure, thereby limiting the flow of gaseous fluids as aforesaid from said device into said enclosure to a pattern which is substantially uniform from end-to-end of the enclosure.

3. A device as defined in claim 1 for introducing air or other gaseous fluid into a room or other enclosure as aforesaid wherein said perforations have a size ranging from 1/16 to 3/16 inch and the total area of the perforations based on the area of said outlet member is in the range of from 8 to 40 percent.

4. The combination of a device for effecting a non-aspirated flow of air or other gaseous fluid into a room or other enclosure having a ceiling and determined vertical and horizontal dimensions with minimal turbulence and means for supplying said fluid to said device, said fluid supplying means comprising: means adapted to be suspended in a fixed location relative to said ceiling which includes an inlet plenum defined by wall means and a supply duct having an outlet which communicates with the interior of said plenum through said wall means, said fluid flow effecting device comprising a perforate outlet member and end walls at the opposite ends of said perforate outlet member, said perforate outlet member being coextensive in length and width with said inlet plenum and fixed to said plenum defining wall means at the lower edges thereof, the perforate outlet member having a generally elliptical cross-sectional configuration with side wall portions which are inclined inwardly from the vertical toward the longitudinal centerplane of the device and perforations so located in the inwardly inclined portions thereof that a selected portion of the gaseous fluid flowing into said enclosure through said outlet member flows therethrough in paths which are generally parallel to said ceiling, the remainder of said perforations being so located in said outlet member as to direct that gaseous fluid flowing therethrough into said enclosure in paths inclined at selected angles relative to said first-mentioned paths; and said fluid flow effecting device further comprising a plurality of downwardly extending vanes housed between said first-mentioned, plenum defining means and said outlet member and extending the length of said plenum and from the lower side of said plenum to said outlet member for proportioning the flow of the fluid introduced into and flowing out of said plenum through said outlet member among those end-to-end spanning segments of the perforate outlet member delineated by the lower edges of said vanes to thereby effect a particularly patterned flow of fluid into said enclosure.

5. A combination as defined in claim 4 wherein said first mentioned, plenum defining means and the outlet member of the device for introducing air or other gaseous fluid into a room or other enclosure as aforesaid extends from wall-to-wall of said enclosure, thereby limiting the flow of gaseous fluids as aforesaid from said device into said enclosure to a pattern which is substantially uniform from end-to-end of the enclosure.

6. A combination as defined in claim 4 which includes a baffle in said inlet plenum for effecting a patterned flow of air thereinto from said supply duct.

7. The combination of a device for effecting a non-aspirated flow of air or other gaseous fluid into a room or other enclosure having a ceiling and determined vertical and horizontal dimensions with minimal turbulence and means for supplying fluid to said device, said fluid supplying means comprising: means adapted to be suspended in a fixed location relative to said ceiling which includes an inlet plenum defined by wall means and a supply duct having an outlet which communicates with the interior of said plenum through said wall means and the device for effecting said non-aspirated flow of fluid comprising: a perforate outlet member below and coextensive in length and width with said inlet plenum and fixed to said plenum defining wall means at the lower edges thereof, said perforate outlet member being arcuately contoured and having inwardly inclined side wall portions, said outlet member including perforations so located that a selected portion of the gaseous fluid flowing into said enclosure through said outlet member flows therethrough in paths which are generally parallel to said ceiling, the remainder of said perforations being so located in said outlet member and that member being so contoured as to direct that gaseous fluid flowing therethrough into paths inclined at selected angles relative to said first-mentioned paths; end walls at the opposite ends of said outlet member; and a plurality of downwardly extending vanes for proportioning the flow of fluid introduced into and flowing out of said plenum through said outlet member among those end-to-end spanning segments of the perforate outlet member delineated by the lower edges of vanes to thereby effect a particularly patterned flow of said fluid into said enclosure, said vanes: all being housed completely within the envelope defined by said perforate outlet member, extending the length of said outlet perforate member, and being supported from said end walls.

8. The combination of a device for effecting a flow of air or other gaseous fluid into a room or other enclosure having a ceiling and determined vertical and horizontal dimensions with minimal turbulence and means for supplying fluid to said device, said fluid supplying means comprising: means adapted to be suspended in a fixed location relative to said ceiling which includes an inlet plenum defined by wall means and a supply duct having an outlet which communicates with the interior of said plenum through said wall means, said fluid flow effecting device comprising an arcuately contoured perforate outlet member with inwardly inclined side wall portions below and coextensive in length and width with said inlet plenum and fixed to said plenum defining wall means at the lower edges thereof, said perforate outlet member including perforations so located that a selected portion of the gaseous fluid flowing into said enclosure through said outlet member flows therethrough in paths which are generally parallel to said ceiling, the remainder of said perforations being so located in said outlet member as to direct that gaseous fluid flowing therethrough into said enclosure in paths inclined at selected angles relative to said first-mentioned paths; parallel end walls at and fixed to the opposite ends of said perforate outlet member, said end walls matching the configuration of the perforate outlet member and thereby cooperating with said member to confine the flow of fluid through said perforate outlet member to the perforations therethrough; a plurality of downwardly extending vanes housed below said inlet plenum and in said perforate outlet member and extending the length of said perforate outlet member from one to the other of said end walls and from the lower side of said plenum to said perforate outlet member for proportioning the flow of the gaseous fluid introduced into and flowing out of said plenum through said perforate outlet member among those end-to-end spanning segments of the perforate outlet member delineated by the lower edges of vanes to thereby effect a particularly patterned flow of air into said enclosure; and means hinging said vanes at the upper edges thereof from said end walls whereby said vanes can be adjusted to change the spacing of the lower edges of said vanes along said perforate outlet member and thereby vary the pattern in which the fluid is distributed into said enclosure through said outlet member.

9. A combination as defined in claim 8 wherein the device for introducing air or other gaseous fluid into a room or other enclosure as aforesaid has an adjustable stop means for locating the lower edge of each vane as aforesaid along said output member, said adjustable stop means comprising, for each vane, a bracket means at each end of the perforate outlet member which is mounted on the end wall of the device at that end of the perforate outlet member, an adjustment member extending through said bracket and threaded into the associated vane, and a resilient, friction-type retainer associated with each of said adjustment members for retaining that adjustment member in the position to which it is adjusted.

10. A device for effecting a non-aspirated flow of air or other gaseous fluid into a room or other enclosure having a ceiling and determined vertical and horizontal dimensions with minimal turbulence, said device comprising: a perforate outlet member having a generally elliptical cross-sectional configuration with side wall portions which are inclined inwardly from the vertical toward the longitudinal centerplane of the device, the perforate outlet member including perforations so located in the inwardly inclined portions thereof that a selected portion of the gaseous fluid flowing into said enclosure through said outlet member flows therethrough in paths which are generally parallel to said ceiling, the remainder of said perforations being so located in said outlet member as to direct that gaseous fluid flowing therethrough into said enclosure in paths inclined at selected angles relative to said first-mentioned paths; a plurality of downwardly extending vanes housed in said outlet member and extending the length of and to the lower side of said outlet member for proportioning the flow of the fluid flowing through said outlet member among those end-to-end spanning segments of the perforate outlet member delineated by the lower edges of said vanes to thereby effect a particularly patterned flow of fluid into said enclosure; walls at the opposite ends of said perforate outlet member; and means for pivotally fixing the upper edges of said vanes to said end walls at the upper edges of the latter about axes extending from end-to-end of said device whereby said vanes may be pivoted about said axes to vary the widths of the outlet member segments spanned by the lower edges of said vanes to thereby vary the proportioning of the flow of fluid as aforesaid among the segments of the perforated outlet member delineated by the lower edges of said vanes, and, consequentially, the pattern in which the fluid is introduced into the enclosure.

11. A device as defined in claim 10 introducing air or other gaseous fluid into a room or other enclosure as aforesaid which has an adjustable stop means for locating the lower edge of each vane as aforesaid along said outlet member, said adjusting means comprising, for each vane; a bracket means at each end of the outlet member and an adjustable member threaded therethrough and into the associated vane.

12. The combination of a device for effecting a non-aspirated flow of air or other gaseous fluid into a room or other enclosure having a ceiling and determined vertical and horizontal dimensions with minimal turbulence and means for supplying said fluid to said device, said fluid supplying means comprising: means adapted to be suspended in a fixed location relative to said ceiling which includes an inlet plenum defined by wall means and a supply duct having an outlet which communicates with the interior of said plenum through said wall means, and said fluid flow effecting device comprising: a perforate outlet member coextensive in length and width with said inlet plenum and fixed to said plenum defining wall means at the lower edges thereof, the perforate outlet member having a generally elliptical cross-sectional configuration with side wall portions which are inclined inwardly from the vertical toward the longitudinal centerplane of the device and perforations so located in the inwardly inclined portions thereof that a selected portion of the gaseous fluid flowing into said enclosure through said outlet member flows therethrough in paths which are generally parallel to said ceiling, the remainder of said perforations being so located in said outlet member as to direct that gaseous fluid flowing therethrough into said enclosure in paths inclined at selected angles relative to said first-mentioned paths; and a plurality of downwardly extending vanes housed between said first-mentioned, plenum defining means and said outlet member and extending the length of said plenum and from the lower side of said plenum to said outlet member for proportioning the flow of the fluid introduced into and flowing out of said plenum through said outlet member among those end-to-end spanning segments of the perforate outlet member delineated by the lower edges of said vanes to thereby effect a particularly patterned flow of fluid into said enclosure; end walls fixed to said perforate outlet member at the opposite ends thereof; and means for pivotally fixing the upper edges of said vanes to said end walls at the upper edges of the latter about axes extending from end-to-end of said device whereby said vanes may be pivoted about said axes to vary the widths of the outlet member segments spanned by the lower edges of said vanes to thereby vary the proportioning the flow of fluid as aforesaid among the segments of the perforated outlet member delineated by the lower edges of said vanes and, consequentially, the pattern in which the fluid is introduced into the enclosure.

13. A device for effecting a non-aspirated flow of air or other gaseous fluid into a room or other enclosure having a ceiling and determined vertical and horizontal dimensions with minimal turbulence, said device comprising: a perforate outlet member having a continuously curved cross-sectional configuration providing a horizontally oriented, curved bottom wall portion which transitions into curved, generally vertical side wall portions which are inwardly inclined at their upper edges and perforations through said side wall portions so located that a selected portion of the gaseous fluid flowing into said enclosure through said outlet member flows therefrom in paths which are generally parallel to said ceiling and perforations through said bottom and side wall portions which are so located as to direct that gaseous fluid flowing therethrough into said enclosure in paths inclined downwardly at selected angles relative to said first-mentioned paths; end walls at the opposite ends of said perforate outlet member; and a plurality of downwardly extending vanes housed in said perforate outlet member for proportioning the flow of the fluid flowing through said outlet member among those segments of the perforate outlet member delineated by the lower edges of said vanes to thereby effect a particularly patterned flow of fluid into said enclosure.

14. A device as defined in claim 13 for introducing air or other gaseous fluid into a room or other enclosure as aforesaid wherein said perforations have a size ranging from 1/16 to 3/16 inch and the total area of the perforations based on the area of said perforate outlet member is in range of from 8 to 40 percent.

15. The combination of a device for effecting a non-aspirated flow of air or other gaseous fluid into a room or other enclosure having a ceiling and determined vertical and horizontal dimensions with minimal turbulence and means for supplying said fluid to said device, said fluid supplying means comprising: an inlet plenum and a supply duct which communicates with the interior of said plenum, said fluid flow effecting device comprising a perforate outlet member having a convex bottom wall portion and inwardly inclined side wall portions which are so configured and related to said bottom wall portion that said outlet member has a continuously curved cross-sectional configuration and end walls at the opposite ends of said perforate outlet member, the inwardly inclined side wall portions of said perforate outlet member being so contoured and having perforations so located that a selected portion of the gaseous fluid flowing into said enclosure through said outlet member flows therefrom in paths which are generally parallel to said ceiling and the bottom wall portion of said outlet member being so contoured and having perforations so located as to direct that gaseous fluid flowing therethrough into said enclosure in paths inclined downwardly at selected angles relative to said first-mentioned paths; and said fluid flow effecting device further comprising a plurality of downwardly extending vanes for proportioning the flow of the fluid introduced into and flowing out of said plenum through said outlet member among those end-to-end spanning segments of the perforate outlet member delineated by the lower edges of said vanes to thereby effect a particularly patterned flow of fluid into said enclosure.

16. The combination of a device for effecting a non-aspirated flow of air or other gaseous fluid into a room or other enclosure having a ceiling and determined vertical and horizontal dimensions with minimal turbulence and means for supplying fluid to said device, said fluid supplying means comprising an inlet plenum and a supply duct which communicates with the interior of said plenum and the device for effecting said non-aspirated flow of fluid comprising: a perforate outlet member which has an arcuate cross-sectional configuration with a bottom wall portion which transitions into inwardly curved side wall portions and includes perforations so located that: (1) a selected portion of the gaseous fluid flowing into said enclosure through said outlet member flows therefrom in paths which are generally parallel to said ceiling, and (2) the remainder of the gaseous fluid flowing through said outlet member flows therefrom in paths inclined downwardly at selected angles relative to said first-mentioned paths and without voids between said paths; end walls at the opposite ends of said outlet member; and a plurality of downwardly extending vanes for proportioning the flow of air introduced into and flowing out of said plenum through said outlet member among those segments of the perforate outlet member delineated by the lower edges of said vanes to thereby effect a particularly patterned flow of said fluid into said enclosure.

* * * * *